US007900659B2

(12) United States Patent
Whitley et al.

(10) Patent No.: US 7,900,659 B2
(45) Date of Patent: Mar. 8, 2011

(54) PRESSURE EQUALIZING DEVICE FOR VIAL ACCESS

(75) Inventors: Kenneth W. Whitley, Franklinton, NC (US); John C. Phillips, New Hill, NC (US)

(73) Assignee: CareFusion 303, Inc., San Diego, CA (US)

( * ) Notice: Subject to any disclaimer, the term of this patent is extended or adjusted under 35 U.S.C. 154(b) by 1113 days.

(21) Appl. No.: 11/642,360

(22) Filed: Dec. 19, 2006

(65) Prior Publication Data

US 2008/0142388 A1 Jun. 19, 2008

(51) Int. Cl.
*B65B 1/04* (2006.01)

(52) U.S. Cl. ..... 141/27; 141/7; 141/59; 141/286; 141/329; 141/366; 604/411; 604/416

(58) Field of Classification Search ..... 141/2, 4, 141/5, 7, 21, 23, 25, 27, 59, 285, 286, 301, 141/302, 329, 330, 346, 363, 366, 383; 604/411–413, 416
See application file for complete search history.

(56) References Cited

U.S. PATENT DOCUMENTS

| | | | | |
|---|---|---|---|---|
| 4,673,404 | A * | 6/1987 | Gustavsson | 604/411 |
| 6,684,918 | B1 * | 2/2004 | Thilly et al. | 141/25 |
| 2006/0106360 | A1 | 5/2006 | Wong | |

FOREIGN PATENT DOCUMENTS

| | | |
|---|---|---|
| EP | 0126718 A2 | 11/1984 |
| WO | WO 84/04672 | 12/1984 |
| WO | WO 96/32917 | 10/1996 |

OTHER PUBLICATIONS

International Search Report/Written Opinion PCT/US2007/025961 mailed Apr. 22, 2008.

* cited by examiner

*Primary Examiner* — Timothy L Maust
*Assistant Examiner* — Jason K Niesz
(74) *Attorney, Agent, or Firm* — McDermott Will & Emery LLP

(57) ABSTRACT

A pressure-equalizing vial access device and method providing closed and sealed reconstitution of vial contents. A rigid container with a fixed internal volume is connected with a vent lumen extending into the vial. As pressure in the vial increases, the pressure is equalized with atmospheric pressure by varying the volume of a compartment within the rigid container. The compartment is formed with a volume control device that automatically varies the volume of the compartment in the rigid container to accommodate and equalize the pressure in the vial by increasing or decreasing the volume of the compartment. In one case the volume control device comprises a sliding disk and in another, a bladder that compresses with an increase in volume in the container and expands with a decrease.

29 Claims, 9 Drawing Sheets

PRESSURE EQUALIZING DEVICE FOR VIAL ACCESS

BACKGROUND OF THE INVENTION

The invention is related generally to vial access devices of the type used in the transfer of medical fluids between a vial and another medical fluid container, and more particularly, to sealed vial access devices providing a closed system to avoid the formation of aerosols escaping to the outside atmosphere.

Many medicaments are prepared, stored, and supplied in dry or lyophilized form in glass vials. Such medicaments must be reconstituted at the time of use by the addition of a diluent thereto. Many pharmaceutical products supplied in glass vials have a closure that can be penetrated by a syringe so as to add or subtract material from the container. For example, often times, medicines are supplied in dry form inside a vial having a rubber closure or stopper. Liquid such as deionized water is added to the vial to dissolve or suspend the solid material. Sometimes, serum and other medicines are freeze dried in the vial and are then reconstituted in the vial. Various methods of adding the diluent to the dry or lyophilized medicament have been used over the years. One method that is commonly used is the vial access device technique wherein a cannula is inserted at the vial access device through the vial stopper and then attaching a bottle or a syringe that contains the diluent to the vial access device. Once the diluent container is connected, the diluent is communicated to the dry or lyophilized medicament residing in the vial resulting in reconstitution of the medication in liquid form. After reconstitution, the liquid is usually withdrawn from the vial into the intravenous solution bottle or syringe, or other container for administration to the patient through an intravenous ("IV") administration set or by other means.

Vials made of glass or polymeric materials, the walls of which are non-collapsible, require an air inlet when medical fluid is withdrawn to prevent the formation of a partial vacuum in the vial. Such a partial vacuum inhibits fluid withdrawal from the vial. Typically, adapters for use with such vials have a sharpened cannula that includes both a medicament fluid lumen and a vent lumen therein. The vent lumen may provide pressure equalization when fluid is added to the vial or is withdrawn from the vial so that such fluid movement occurs smoothly.

Access ports for injecting fluid into or removing fluid from a container, such as a drug vial, are well known and widely used. Conventional seals of drug vials generally involve a pierceable rubber stopper formed of an elastomeric material such as butyl rubber or the like, placed in the opening of the vial. A closure, typically formed of metal, is crimped over the rubber stopper and the flange of the vial to positively hold the stopper in place in the opening of the vial. The closure has an outer size, known as a "finish size." A sharp cannula is inserted through the rubber stopper to position the distal, open end of the cannula past the rubber stopper to establish fluid connection with the interior of the vial. In the case of certain medications, such as those used for chemotherapy or nuclear medicine, the rubber stopper is made thicker so that increased protection is provided against leakage.

Vial access devices have been found useful in that their sharpened cannula is used to pierce the stopper and move far enough into the vial interior to establish fluid communication between the vial and the connection device of another fluid container or fluid conduction device. For example, the adapter may include a female Luer fitting opposite the sharpened cannula to receive the male luer of a syringe. The "adapter" therefore adapts the vial to the syringe, or adapts the sharpened cannula to the male luer of the syringe.

It has also been found useful in some applications to provide a means to attach or anchor the adapter to the vial to hold it in place while fluid communication between the vial and another device proceeds so that inadvertent disengagement of the adapter from the vial does not occur. For example, the adapter may have arms that engage the neck or flange of the vial and hold the adapter in place on the vial. Other means include a circular slotted housing that fits around the outside of the vial closure and snaps onto the vial closure under the crimped retaining cap on the under-surface of the vial's flange thereby grasping the vial neck flange and the underside of the closure. The circular housing typically has a plurality of claws or other retaining devices that are positioned under the flange of the vial opening thereby interfering with removal of the adapter from the vial.

When an ordinary container and closure is used to dispense medicines which have been reconstituted, several problems are created. Normally when a liquid is added to a powder in a vial there is an increased pressure in the container and syringe due to the change in volume. This pressure tends to force a discharge of the liquid through an opening formed by the closure puncture and the hypodermic needle point, either when the needle is withdrawn or later when a needle is inserted to withdraw some of the contents.

Another difficulty arises when the powders and the newly formed liquids experience aerosoling. This phenomenon occurs when small particles or droplets, either powder or in the liquid state, become airborne during the turbulence caused from the pressure released during withdrawal or insertion of the needle into the container. Thus, these airborne particles escape from the container and may contact the healthcare worker.

Advances in modern medicine have made the aerosoling problem and others as described above much more serious. Specifically, during the treatment of cancer, chemotherapy drugs are packaged in glass vials in a freeze dried form and are thereafter reconstituted at the time when treatment is beginning. Various quantities of the reconstituted liquid are withdrawn over a period of time using syringes. Because cancer treating drugs are often times powerful, sometimes causing retardation or stoppage of all cell growth, it is obviously an advantage to avoid having unnecessary contact. Every effort is made to avoid contact by the preparer and dispenser of chemotherapy drugs. Not only cancer treating materials are of concern. As AIDS and AIDS-related diseases are treated, drugs which are used may not be safe for universal contact. Antibiotics and cloning drugs also need to be carefully monitored.

For such reconstitution activities, a vented vial access device is used to avoid any difficulties with a partial vacuum or high pressure inside the vial. These are sometimes known as pressure-equalizing vial access devices. However, with some vented vial access devices this technique is unsatisfactory because both the dry or lyophilized material and the diluent can be exposed to ambient airborne bacterial contamination during withdrawal of the reconstituted medical fluid if a filter is not present in the vial access device.

During the reconstitution process of certain medical fluids, such as chemotherapy fluids or nuclear medicines, it is also desirable to avoid contamination of the surrounding air resulting from the formation of aerosols or drops in the vial. As used herein, aerosols are suspensions of solid or liquid particles in a gas, such as air. Contamination is possible during the injection of the diluent into the vial because more material is being added to the closed space of the vial and therefore, the vent of the adapter must channel away an equal amount of air from the vial to make room for the additive. If this air removed from the vial is channeled to the outside atmosphere, such contamination can lead to problems, among other things, in the form of allergic reactions in the exposed personnel, especially when the air is contaminated with cytotoxic drugs, chemotherapeutic drugs, anesthetics, media containing isotopes, and allergy inducing substances of various kinds.

Traditionally, drugs are aspirated from vials having rigid walls by the following process:

a. the user aspirates a volume of air into a syringe that is equal to the volume of drug to be removed from a vial;
b. the user pierces the top of the drug vial with a needle that is attached to the syringe;
c. the user depresses the plunger on the syringe, injecting the air from the syringe into the vial which causes an increase in pressure within the vial; and
d. a volume of drug is aspirated from the vial, allowing the pressure within the vial to drop back to near atmospheric pressure.

If the vial is accessed more than once in this manner and the volume of air that is injected is slightly more than the volume of drug that is removed, the pressure within the vial will gradually increase. If the pressure becomes too high, some drug may spray from the needle hole in the vial closure as the needle is removed. If the drug contained in the vial is toxic, it may harm anyone who then contacts the loose drug.

Chemotherapy pins are frequently used to aspirate chemotherapy drugs from vials. Chemo pins contain a hydrophobic membrane and filter that act as a barrier between the drug and outside atmosphere. This barrier allows air to enter and exit the vial as drug is removed while preventing liquid from escaping and filtering the gases that pass through it. This prevents the buildup of pressure within the vial as described above. However, many nurses and pharmacists do not trust that the filter prevents all harmful vapors from escaping the vial and reaching the atmosphere. Therefore, most users are required to use the chemo pin under a vent hood within the pharmacy.

Prior approaches provide a sealed or closed system. However, problems have persisted. For example, one system is attached to a drug vial and then a syringe is used to prime the vial with a volume of air equal to the volume of fluid that will be withdrawn from the vial. The approach uses a thin, flexible section that is in fluid communication with the syringe and the vial. The thin, flexible section expands outward as the syringe is used to force air into the vial, preventing an increase in gas pressure within the vial. Then as fluid is removed from the vial, the flexible section collapses, preventing a decrease in pressure (vacuum) within the vial. However, the thin, flexible section expands outward making it vulnerable to rupture if it contacts a sharp object. Also, if over inflated, it may likewise rupture. Additionally, if the user forgets to prime the vial with air before aspirating the drug, a vacuum will develop within the vial which will inhibit the withdrawal of fluid from the vial.

Hence, those skilled in the art have recognized a need for a pressure-equalizing vial access device having improved aerosol retention capability so that reconstituted contents of the vial that become aerosolized do not escape the vial to the atmosphere. The present invention fulfills these needs and others.

SUMMARY OF THE INVENTION

Briefly and in general terms, the present invention is directed to a system and a method for use in reconstituting medicaments in rigid vials in which pressure equalizing is performed to prevent aerosols from escaping to the atmosphere. The invention prevents the buildup of pressure within a vial while maintaining a sealed vial access system. It allows pressure within the vial to remain constant as vial contents are reconstituted and aspirated, but does not allow any fluid or gases to escape into the atmosphere.

In accordance with one aspect of the invention, there is provided a pressure-equalizing vial access device for retaining aerosols when accessing a vial having a pierceable seal located over an opening of the vial, the vial access device comprising a cannula having a medicament lumen and a vent lumen separate from the medicament lumen, the cannula having a relatively sharp tip to pierce the seal of the vial and a length selected so that the tip can be located within the vial, a body portion having a medicament port in fluid communication with the medicament lumen of the cannula, the medicament port configured to receive a connector from a second container to allow liquid to be introduced into and removed from the vial, and a vent port in fluid communication with the vent lumen of the cannula, the vent port being separate from the medicament port and configured to allow passage of gas to and from the vent lumen, and a rigid chamber located in fluid communication with the vent port and the vent lumen without being in fluid communication with the medicament port or medicament lumen, the rigid chamber having a pressure relief port open to atmosphere and an equalizing port connecting to the vent port and vent lumen, the rigid chamber having rigid walls and a fixed internal volume, the rigid chamber comprising a filter disposed at the equalizing port of the rigid chamber so that any fluid passing between the rigid chamber and the vent port must pass through the filter, and a volume control device located within and entirely confined by the rigid chamber providing a sealed barrier between the equalizing port and the pressure relief port and freely movable between the equalizing port and the pressure relief port to vary the internal volume of the rigid chamber available to the equalizing port in response to pressure changes occurring in the vent lumen whereby increases in pressure in the vial resulting from the introduction of liquid for reconstitution of vial contents are equalized by the volume control device moving away from the equalizing port to create a greater volume in the vent lumen/rigid chamber combination and decreases in pressure in the vial resulting from aspiration of reconstituted liquid from the vial contents are equalized by the volume control device moving toward the equalizing port to create a lesser volume in the vent lumen/rigid chamber combination.

In further aspects, the volume control device automatically moves within the rigid chamber to vary the volume of the rigid chamber adjacent the equalizing port to accommodate an increase in pressure in the vial or a decrease in pressure in the vial so that the pressure within the vial is maintained at approximately atmospheric pressure. The volume control device comprises a sliding disk freely movable within the rigid chamber between the equalizing port and the pressure relief port to vary the volume of the rigid chamber available to the equalizing port and vent lumen, the disk having an outer periphery having a seal in contact with an inner wall of the rigid chamber to seal the vent lumen from the pressure relief port of the rigid chamber. The volume control device comprises a cylinder closed at one end having a seal located at its outer periphery. The filter comprises a hydrophobic membrane.

In other aspects, the volume control device comprises a flexible bladder mounted within the rigid chamber such that the bladder compresses when the volume between the equalizing port and the volume control device increases. The volume control device comprises a flexible bladder mounted within the rigid chamber such that it expands when the volume between the equalizing port and the volume control device decreases. The rigid chamber is formed of a clear material such that the volume control device is visible and can indicate visually the volume available for air to be injected into the vial and liquid to be removed from the vial. The bladder is formed of a vapor impermeable material thereby sealing the rigid chamber from gases escaping the vial.

In yet further aspects, the rigid chamber is formed so that the volume within it on both sides of the volume control device when centered is equal to the volume of space within an empty vial. The medicament port comprises a needle free valve. The needle free valve comprises a female Luer connection port.

In accordance with method aspects of the invention, there is provided a method for retaining aerosols when accessing a vial having a pierceable seal located over an opening of the vial, the method comprising piercing the vial seal to establish fluid communication with vial contents, conducting liquid into the vial through a medicament lumen, when pressure in the vial increases above atmospheric pressure, conducting gas out of the vial through the vent lumen which is separate from the medicament lumen, filtering the gas conducted out of the vial, confining the filtered gas conducted out of the vial in a sealed container having rigid walls and a fixed volume, dividing the sealed container into two compartments, varying the volume of a first compartment of the sealed container to receive the filtered gas conducted out of the vial and equalize the received filtered gas to atmospheric pressure thereby equalizing the pressure in the vial to atmospheric pressure, returning the received filtered gas to the vial when pressure in the vial decreases below atmospheric pressure thereby equalizing the pressure in the vial to atmospheric pressure, whereby increases in pressure in the vial resulting from the introduction of liquid for reconstitution of vial contents are equalized by increasing the volume in the first compartment of the rigid chamber combination and decreases in pressure in the vial resulting from aspiration of reconstituted liquid from the vial contents are equalized by decreasing the volume of the first compartment.

In accordance with further method aspects, the step of varying the volume of the first compartment comprises automatically moving a sealed barrier located within the rigid container in response to pressure changes in the vial to vary the volume of the first compartment. The step of varying the volume of the first compartment comprises automatically moving a freely-movable sliding disk within the rigid container in response to pressure changes in the vial to vary the volume of the first compartment, the sliding disk sealing the first compartment from the atmosphere. The step of filtering comprises blocking the passage of liquid.

In yet other method aspects, the step of varying the volume of the first compartment comprises automatically moving a freely-movable flexible bladder within the rigid container in response to pressure changes in the vial to vary the volume of the first compartment, the flexible bladder sealing the first compartment from the atmosphere. The step of varying the volume comprises mounting the flexible bladder within the rigid-walled container such that the bladder compresses to receive gas from the vial and expands to provide gas to the vial, the bladder contained within the rigid container such that the bladder in its expanded and compressed states is contained entirely within the rigid container. The step of viewing the volume available in the rigid container through the wall of the rigid container to determine the amount of liquid for injection into the vial. Controlling the injection and aspiration of fluid from the vial with a needle free valve disposed in the path of the medicament lumen. Receiving a Luer connector of a second container with a Luer-shaped connector located in the path of the medicament lumen These and other aspects, features, and advantages of the present invention will become apparent from the following detailed description of the preferred embodiments which, taken in conjunction with the accompanying drawings, illustrate by way of example the principles of the invention.

DETAILED DESCRIPTION OF THE INVENTION

Figure 1:
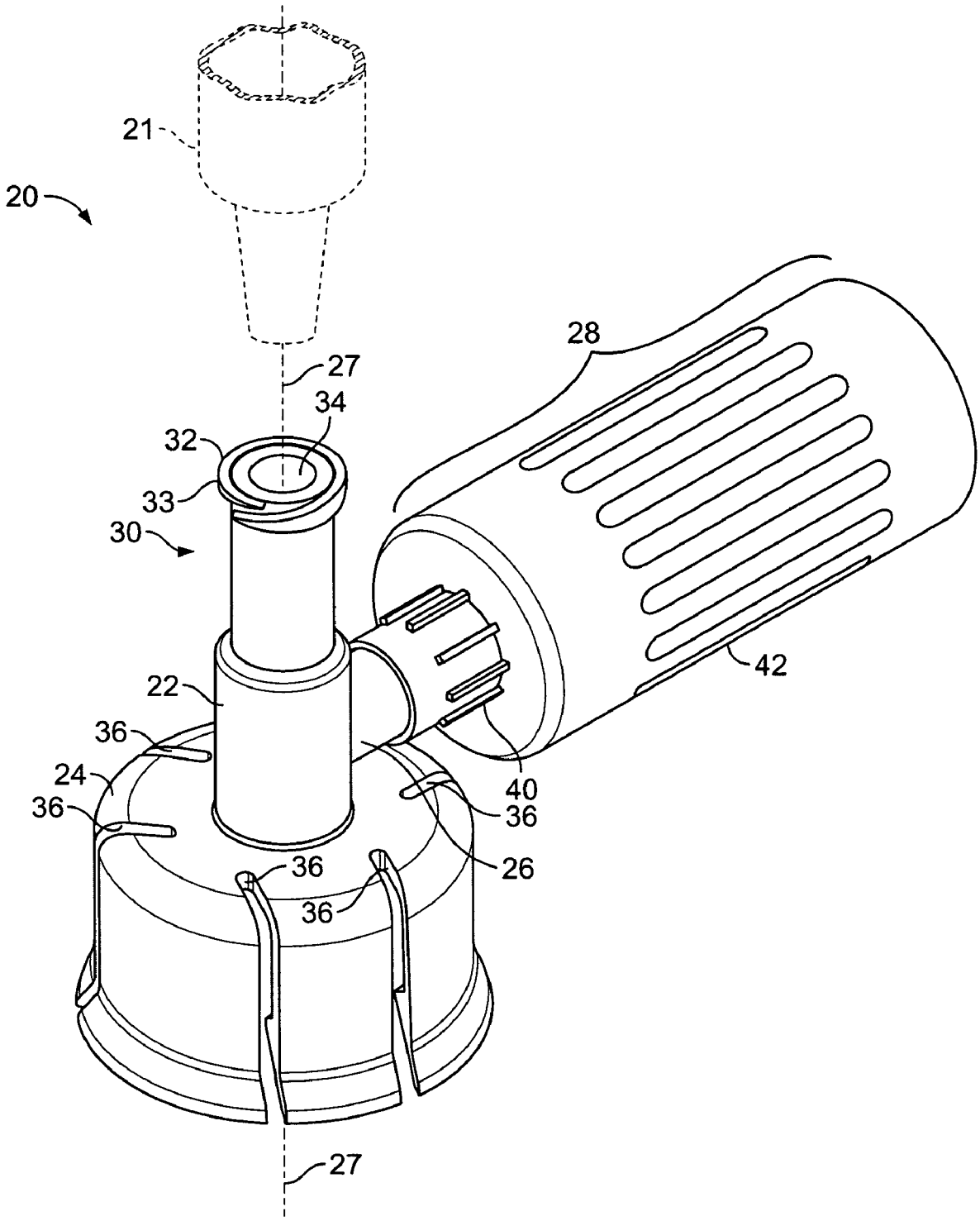
FIG. 1 is a perspective view of a pressure-equalizing vial access device from the angle of the female connector that forms a medicament port to which another medical fluid container, such as the syringe shown in part, may be connected to the vial access device showing also a slotted vial connector housing, a side vent arm, and a rigid pressure equalizing chamber for use in equalizing the pressure in a rigid-walled vial during reconstitution of the vial contents and subsequent aspiration.
Figure 2:
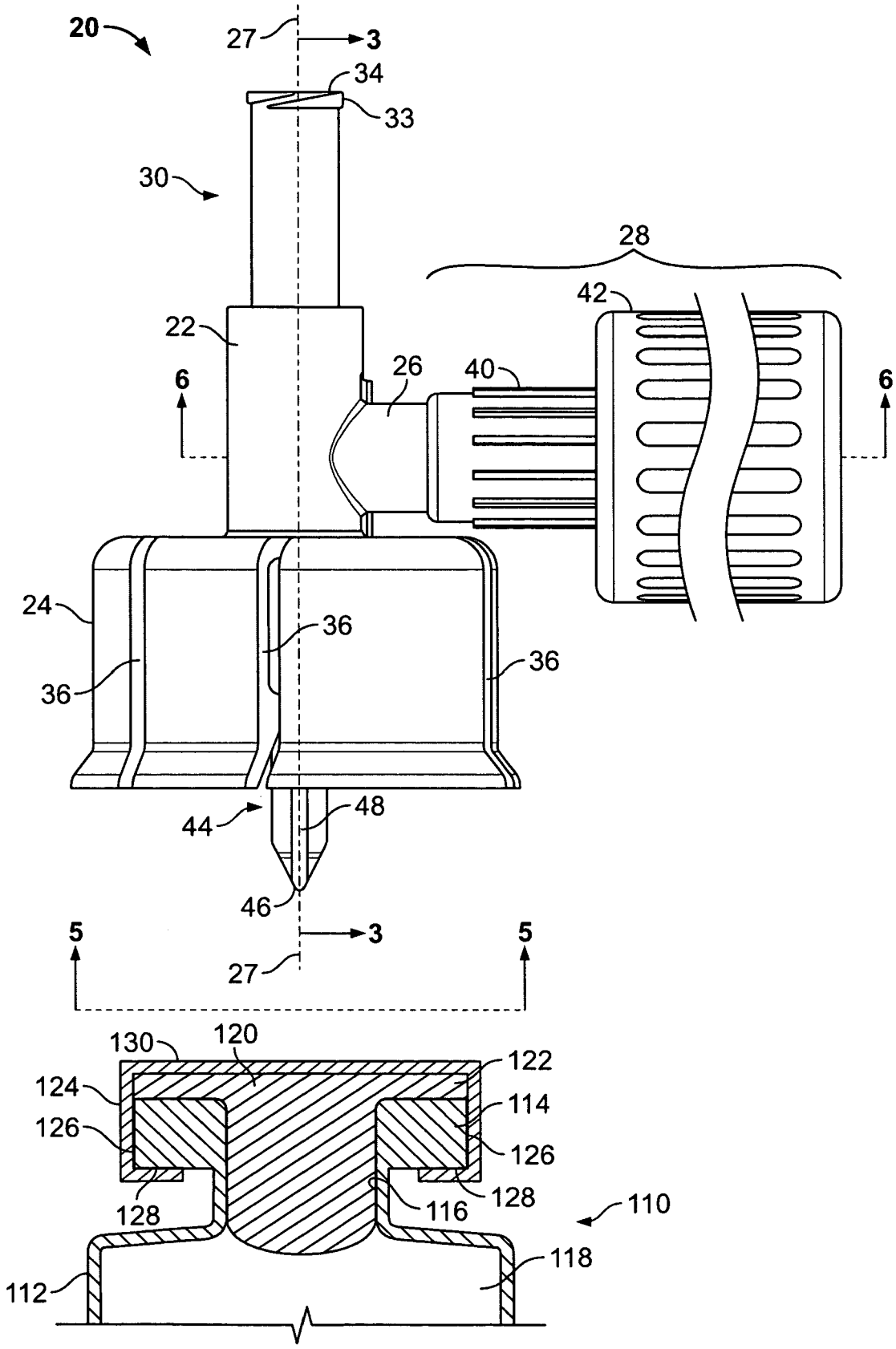
FIG. 2 is a side view of the vial access device of FIG. 1 positioned above the opening portion of a rigid-walled vial, and showing a cannula having a relatively sharp tip for piercing the septum of the vial while the slotted connector housing becomes attached to the vial flange to thereby securely mount the vial access device or vial adapter to the vial during the performance of reconstitution and aspiration activities with the vial.

Referring now to the drawings in more detail in which like reference numerals refer to like or corresponding devices among the views, there is shown in FIGS. 1 and 2 a view of an embodiment of a pressure-equalizing vial access device 20 in accordance with aspects of the invention. Above the vial access device is shown a portion of a syringe 21 usable with the access device to provide liquid to a rigid vial to reconstitute its contents and to then aspirate the reconstituted contents for administration to a patient.

Referring now in more detail to FIGS. 1 and 2, the vial access device 20 comprises a body portion 22, a slotted vial attachment housing 24, a vent arm 26 formed at a ninety degree angle to the longitudinal axis 27 of the body portion in this embodiment, a pressure-equalizing chamber 28, a female Luer connection port 34, external threads 33 for coupling to a male connector, a female luer connection port 34, and a sharpened cannula 44 for piercing the septa of sealed vials. Referring in more detail to FIG. 2, a part of a vial 110 is also shown. The vial includes a rigid wall 112 that does not expand or collapse as fluid is being introduced to the vial or fluid is withdrawn from the vial, respectively. The vial includes a vial flange 114 with an opening 116 that permits access to the internal chamber 118 of the vial. In this view, the opening of the vial is sealed with a septum 120 that includes a septum flange 122 covering a portion of the vial flange. Securing the septum in place is a crimped closure 124 that is formed over the septum on the top of the vial flange, extending around the outer surface 126 of the vial flange, and crimped to the undersurface 128 of the vial flange thereby securely retaining the septum in position to seal the opening of the vial. The closure includes a port 130 through which a sharpened cannula may be forced to make fluid communication with the internal chamber of the vial. In the case of FIG. 2, the sharpened cannula 44 of the vial access device 20 positioned above the vial 110 may be used. Even though FIG. 2 is not drawn to scale, it will be noted that the vial attachment housing 24 is sized to fit over the vial flange 114 while the cannula extends into the vial inner chamber 118 for fluid communication. The slots 36 enable the housing to flex outward thereby expanding to accept the vial flange and closure 124. For further details on the slotted housing 24 for connecting to vials, see U.S. Pat. No. 6,875,205 to Leinsing, incorporated herein by reference.

Figure 3:
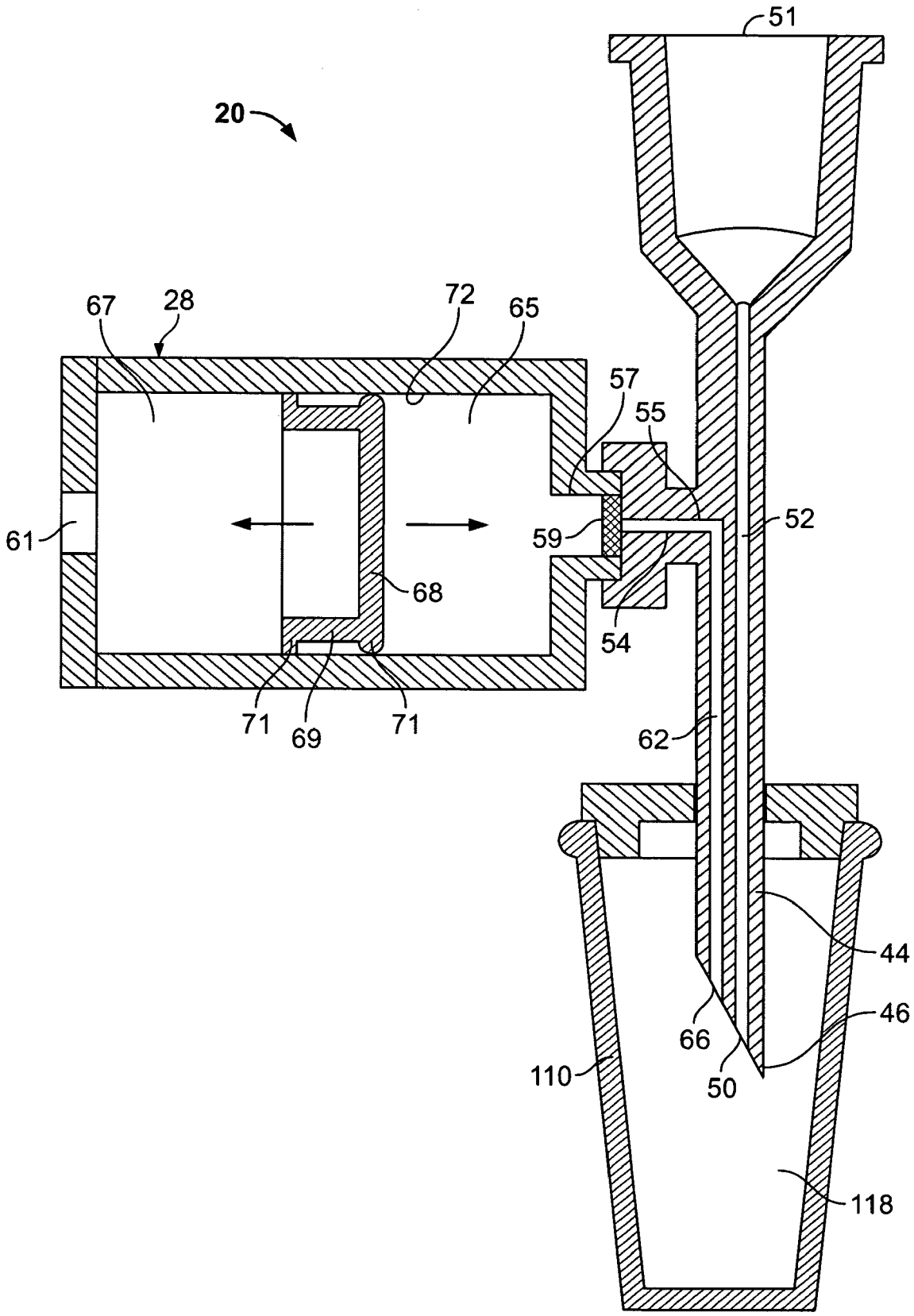
FIG. 3 is a cross-sectional view of a first embodiment of a pressure-equalizing vial access device in accordance with aspects of the invention showing a freely-slidable disk located in a pressure equalizing chamber for maintaining the vial at atmospheric pressure during reconstitution and aspiration of the vial's contents.

Referring now to FIG. 3, the sharpened cannula or vial access pin 44, forming part of vial access device 20 or "VAD," has two lumina formed through it. The medicament lumen 52 connects a medicament opening 50 formed in the sharp cannula 44 of the VAD to a medicament port 51 configured to receive a syringe (shown in FIG. 1). In this case, the medicament port has a standard female Luer shape, although other configurations may be used. The sharp cannula is shown located within chamber 118 of the vial 110 at which location it may be used to provide liquid to reconstitute the contents of the vial, and aspirate the reconstituted contents. The vent lumen 62 connects the inside of the vial 118 to a rigid pressure equalizing chamber 28. The vent lumen includes an opening 66 on the sharp tip 46 and a vent port 54 located at the rigid chamber 28. In this case, the vent port is located at a right angle 55 to the medicament lumen 52 approximately one-half way between the vial 110 and the medicament port 51. Other angles and other locations for the vent port may be used.

At the vent port 54 and disposed within the equalizing port 57 of the equalizing chamber 28 is mounted a hydrophobic membrane 59 to act as a filter. This filter is constituted so as to prevent or at least inhibit liquid from entering the equalizing chamber 28 from the vial 110. Other types of hydrophobic filters may be used as desired.

The equalizing chamber 28 includes the equalizing port 57 as previously discussed and a pressure relief port 61. The pressure relief port thus communicates the atmospheric pressure from outside the chamber. In accordance with an aspect of the invention, the chamber 28 is divided into a portion 65 in communication with the equalizing port 57 and a portion 67 in communication with the pressure relief port 61. In this case, the chamber is divided with a disk 68 that is mounted within the chamber so that it is freely sliding within the chamber in response to the relative pressures on either side of it. Where the pressure is lower than atmospheric pressure on the side of the disk toward the equalizing port, the disk will automatically slide towards the equalizing port thus resulting in less volume within the chamber portion 65 available to the equalizing port. In the case where the pressure is higher than atmospheric pressure on the side of the disk toward the equalizing port, the disk will automatically slide towards the lower pressure located at the pressure relief port thus resulting in more volume within the chamber portion 65 available to the equalizing port and less volume within the chamber portion 67 available to the pressure relief port. As a result of this variable volume available to the vent lumen/equalizing chamber portion, the pressure within the vial can be equalized with atmospheric pressure. By automatically moving to provide changes in volume, the disk prevents a change in pressure within the vial as air is injected into the vial, or liquid is removed from the vial.

In the case shown in FIG. 3, the sliding disk 68 is in the shape of a piston or a cylinder 69 closed at one end with the disk 68. Other shapes are possible. The outer edge of the disk includes a seal or seals 71 that are in sealing contact with the inner wall 72 of the chamber 28. The seal is selected so that the disk can freely and automatically slide within the chamber yet maintain a seal separating the equalizing port 57 from the pressure relief port 61. Because the disk provides a sliding seal against the inner wall of the chamber, no gases can escape the chamber/vial assembly. In one embodiment, the disk is formed of rubber although other materials may be usable.

If the equalizing chamber 28 is made of a clear material such that the sliding disk 68 is visible, the disk can serve as a visual indicator of how much air can be added or liquid removed form the vial 110. In the embodiment of FIG. 3, the equalizing chamber could be manufactured such that the volume of open space on both sides 65 and 67 of the disk 68 is equal to the volume of space 118 within an empty vial. This would eliminate the need for the user to prime the vial with air prior to aspirating the drug. The user could instead immediately begin aspirating drug into the syringe 21 (FIG. 1), and the disk would move to the right to accommodate the change in volume. In the same manner, the flexible bladder in the second embodiment discussed below could be designed to maintain a neutral shape that can expand or contract with initial use.

In further aspects, the equalizing chamber 21 may have shapes other than a straight cylinder and the chamber can maintain other orientations in relation to the vial 110. In one embodiment, the pressure-equalizing chamber was formed of polycarbonate although other materials may be usable.

Figure 4:
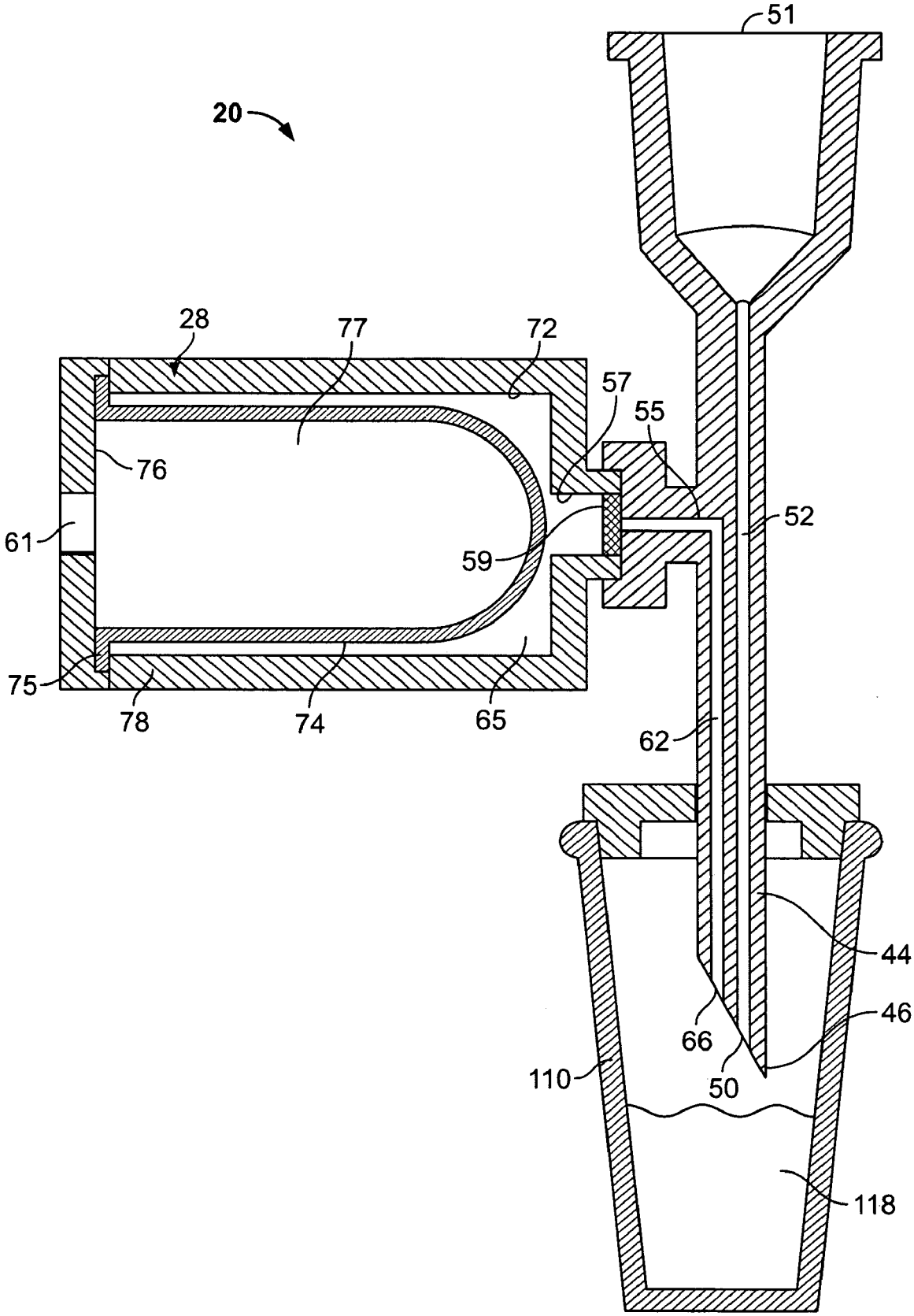
FIG. 4 is a cross-sectional view of a second embodiment of a pressure-equalizing vial access device also in accordance with aspects of the invention showing a flexible bladder located in a pressure equalizing chamber for maintaining the vial at atmospheric pressure during reconstitution and aspiration of the vial's contents, the bladder being mounted so that it compresses when pressure is above atmospheric in the vial and expands when pressure is below atmospheric in the vial.
Figure 5:
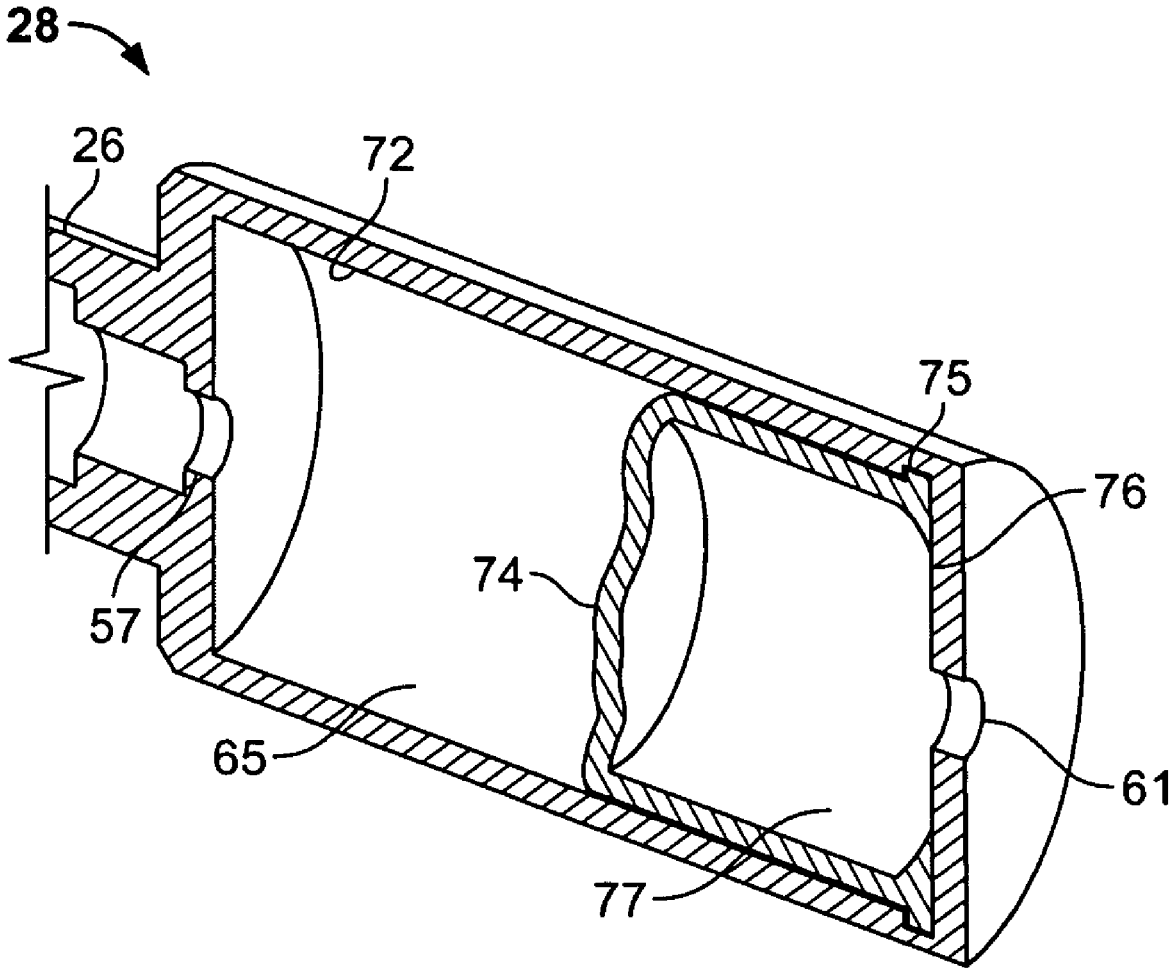
FIG. 5 is a perspective, cross-sectional view of the second embodiment of a volume control device showing the flexible bladder of FIG. 4 in compression so that the volume available to the equalizing port of the chamber is about one-half of the chamber.

An alternative embodiment is shown in FIGS. 4 and 5. This embodiment functions in a similar manner as the embodiment shown in FIG. 3 and described above, but utilizes a flexible bladder 74 to accommodate changes in volume within the vial/chamber assembly rather than the sliding disk 68 of FIG. 3. The result accomplished is the same. The flexible bladder 74 compresses when air is injected into the vial 110 (FIG. 2), increasing the volume of space within the assembly as shown in FIG. 5. When liquid is removed from the vial, the flexible bladder expands, decreasing the volume of space within the assembly, as is shown in FIG. 4. The bladder may be constructed of a material that is vapor impermeable (as an example silicone) and would seal the chamber to prevent gases from escaping the assembly.

Referring now in more detail to FIGS. 4 and 5, the flexible bladder 74 is mounted entirely within the equalizing chamber 28 and is completely confined therein. The bladder includes a mounting flange 75 at one end that, in this embodiment, is mounted at the wall 76 of the chamber in which the pressure relief port 61 is formed. Thus, the inner portion 77 of the bladder is exposed to atmospheric pressure through the pressure relief port. As can be seen from FIG. 4, a part of the bladder mounting flange is held in place between the pressure relief port wall 76 and the side cylindrical wall 78 of the equalizing chamber. The bladder may be held in position at this location due to the mechanical forces of the two abutting walls and may also be held by adhesive or other means. In any case, a seal is formed by the bladder between the equalizing port 57 of the chamber and the pressure relief port 61 of the chamber. Any gases received by the chamber 28 at the equalizing port cannot escape to the atmosphere through the pressure relief port due to the sealing bladder. Two portions within the chamber are thus formed by the bladder, similarly with the sliding disk described above. A first portion 65 is outside the bladder and therefore between the bladder and the equalizing port. A second portion is within the bladder and therefore between the bladder and the pressure relief port. For this reason, the bladder need not make sealing contact with the inner wall 72 of the pressure-equalizing chamber 28 since its seal is disposed at its mounting location. In one embodiment the flexible bladder is elastic although in another embodiment, it need not be elastic.

The hydrophobic filter 59 is shown in FIG. 4 but not in FIG. 5. Such a filter may also be included in FIG. 5 either in the same location as is FIG. 4 or in a different location. Additionally, the equalizing chamber is shown in FIGS. 3 and 4 as being a separate piece that is then attached to the body of the VAD. In other embodiments, the equalizing chamber may be formed integrally with the body 22 of the VAD 20. A different configuration may be used to secure the hydrophobic filter in place between the vent lumen 62 and the equalizing chamber 28.

Figure 6:
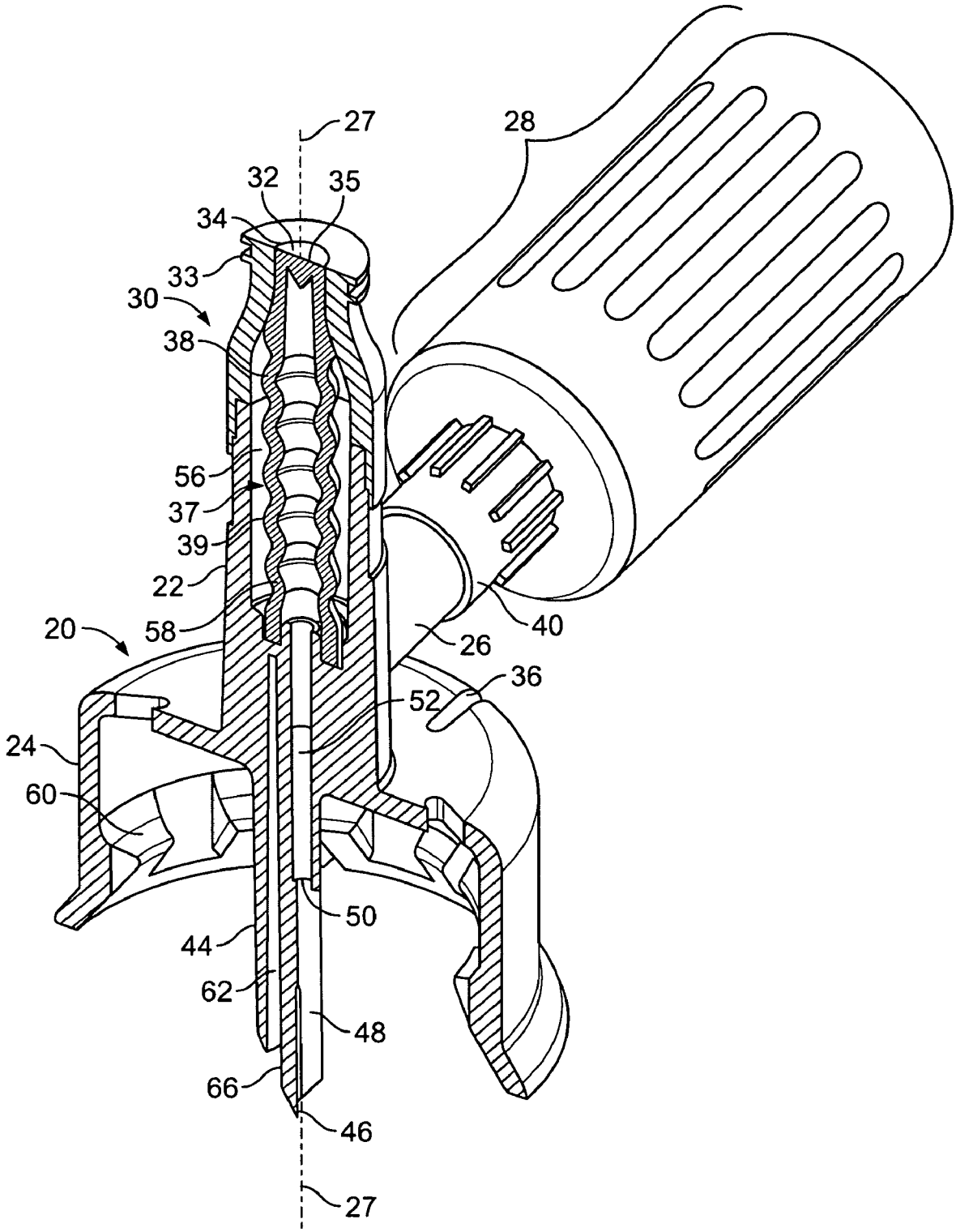
FIG. 6 illustrates a perspective, cross-sectional view of the vial access device of FIGS. 1 and 2 rotated approximately 45° showing a medicament lumen extending through the sharpened cannula and a body portion of the housing, showing a needle free valve disposed in the medicament port, and showing a limited view of the vent arm and pressure-equalizing chamber.

In the illustrated embodiment of FIG. 6, a needle free valve 30 has been formed as part of the medicament port. The needle free valve is shown in cross-section and includes an elastomeric, resilient piston 37 having a piston head 38 attached to a spring section 39. The spring section biases the piston head into the closed configuration shown in FIG. 6. The piston head includes a naturally-open bore 35 that is naturally open and self-opens when the piston head is pushed into the larger diameter 56 section of the body 22. This action also causes the spring section of the piston to compress, storing energy to return the piston head to the closed position at which the bore closes. The needle-free valve connector 30 may take different forms. One form is the SmartSite valve connector from the ALARIS Products division of Cardinal Health, San Diego, Calif. Details on the construction and operation of such a connector are located in U.S. Pat. No. 5,676,346 to Leinsing, incorporated herein by reference.

FIG. 6 also shows the pressure-equalizing chamber 28 in perspective. In this embodiment, the pressure-equalizing chamber has an attachment stem 40 that fits over the side vent arm 26 of the body member 22. The pressure-equalizing chamber 28 is oriented at an angle from the longitudinal axis 27 of the body member. The side 26 arm of the body may be at different angles than that shown and the connection of the pressure-equalizing chamber to the side arm may take other configurations than that shown. As shown in FIG. 6, the valve 32 is in fluid communication with the cannula 44 that is oriented along the longitudinal axis 27 within the vial attachment housing 24. The cannula enters the internal space 118 of the vial 110 (FIG. 2) when the housing is pressed onto a vial, as described above. An open channel or slot 48 is formed in the cannula in this embodiment to guide fluid to the valve 32 and to permit an acceptable flow rate of the medicament when the valve is in its open orientation.

In the cross-sectional perspective view of FIG. 6 a medicament opening 50 in the sharpened cannula 44 is located adjacent the open channel or slot 48 formed in the cannula. The medicament opening is part of a medicament lumen 52 extending through the sharpened cannula and the body portion 22. The medicament lumen is in fluid communication with the valve 32. Adjacent the valve is an enlarged cylindrical cavity 56 formed in the body portion. In this cavity, a circular groove 58 is formed to retain one end of the piston 38. Also shown in FIG. 6 is an anchor device 60 in the form of claws for grasping the underside of a vial flange 114 (FIG. 2) to securely retain the vial access device 20 to the vial 110.

The cross-sectional view of FIG. 6 permits closer inspection of the medicament opening 50 and the medicament lumen 52 in the cannula 44. It can be seen that the medicament opening is approximately perpendicular to the longitudinal axis 27 of the cannula. To allow enough fluid access to the opening 50 so that an adequate medicament flow rate can be obtained, the open channel or slot 48 has been formed in the side of the cannula from the sharp tip 46 to the medicament opening 50 so that more fluid may flow through the medicament opening.

Although not shown completely, a vent lumen 62 can be seen. The vent lumen is separate from the medicament lumen 52 in this embodiment. A vent lumen opening 66 on the cannula 44 is visible at the sharpened tip 46 of the cannula in this embodiment.

Figure 7:
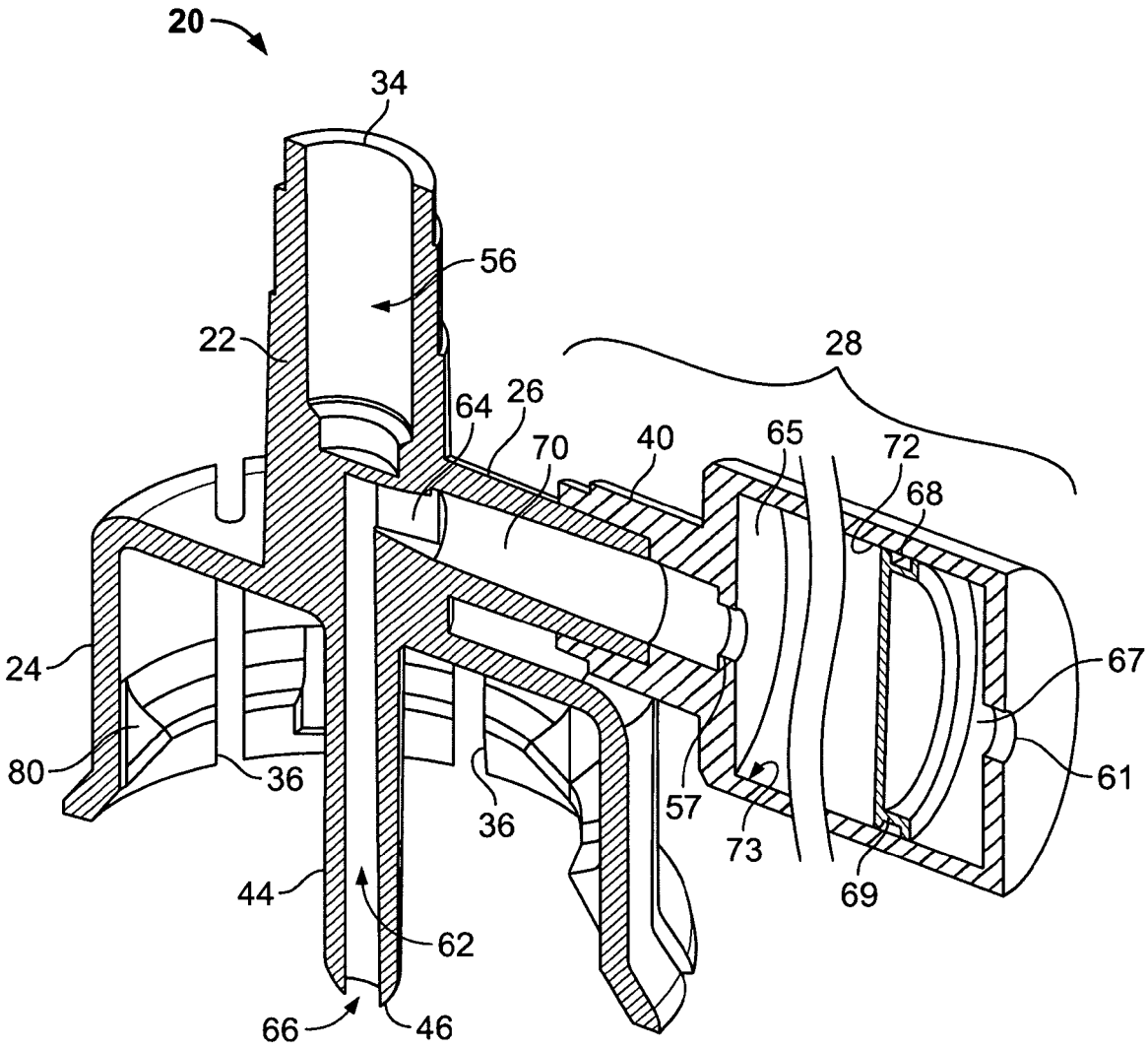
FIG. 7 is a perspective, cross-sectional view of a vial access device shown in FIG. 2 rotated approximately 45° showing the vent lumen proceeding through the sharpened cannula and the body portion, and showing a cross-sectional view of the vent arm, and pressure equalizing chamber having an equalizing port, a pressure relief port, and a freely-slidable, sealing disk in the chamber to equalize pressure of the vial.

FIG. 7 presents a clearer view of the path of the vent lumen 62 through the pressure-equalizing vial access device 20. The body portion 22 includes a right angle vent lumen portion 64 leading to a larger vent lumen cavity 70 in the vent arm 26. The pressure-equalizing chamber 28 is mounted over the vent arm in a secure fashion so that no fluid can escape from the vial through the vent lumen.

Figure 8:
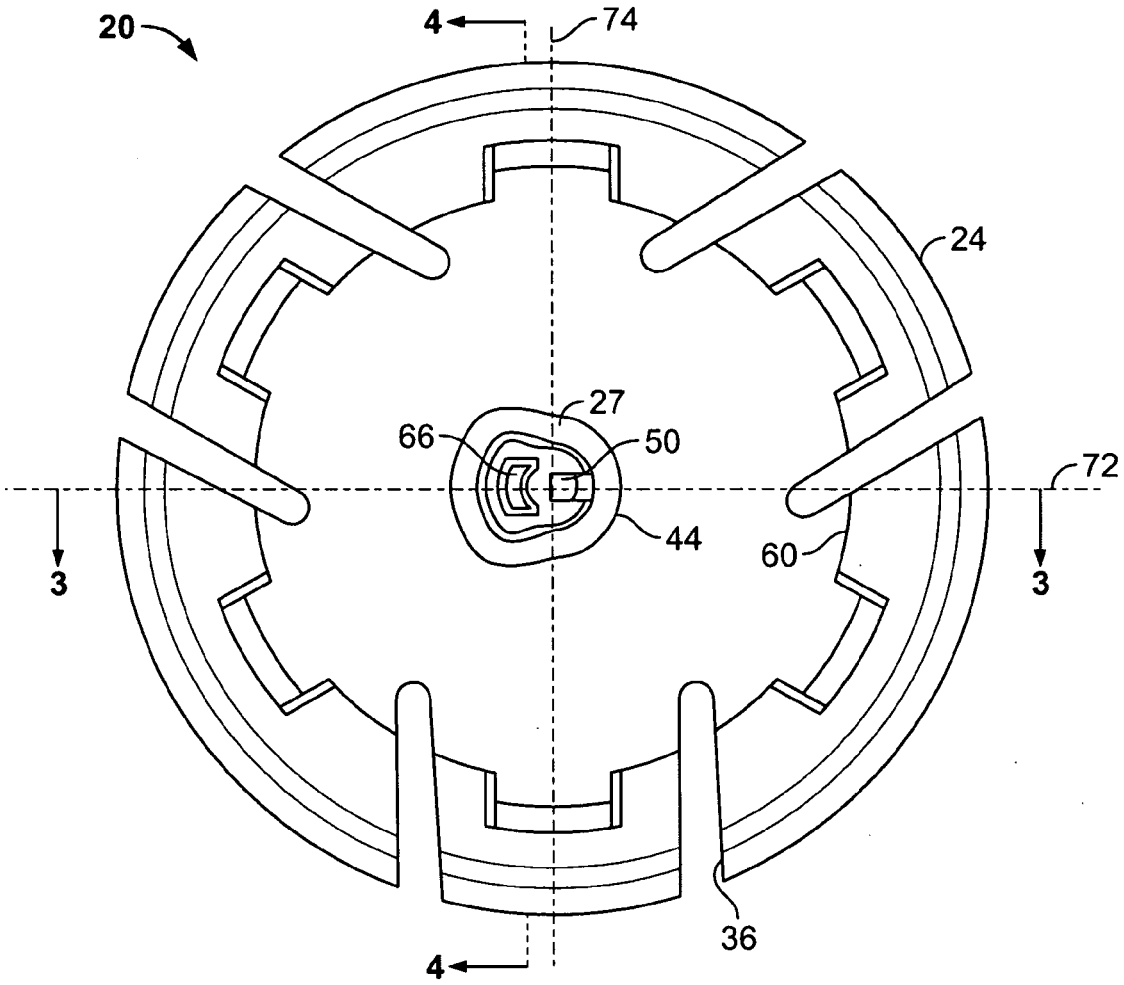
FIG. 8 is a bottom view of the vial access device of FIGS. 1, 2, 6, and 7 showing a plan view of the relatively sharp tip of the cannula revealing the openings of the vent and medicament lumina.

Continuing with further details of the construction of the vial access device housing 24 in this embodiment, FIG. 8 presents a plan view of the bottom of the vial access device of FIGS. 1, 2, 6, and 7 with the pressure-equalizing chamber 28 removed for clarity and ease of illustration. Shown on the cannula 44 are the vent opening 66 and the medicament opening 50 in relation to radial centerlines 72 and 74 of the housing. The medicament opening and the vent opening reside on a common centerline 72. The intersection of the centerlines 72 and 74 marks the longitudinal axis 27 (FIGS. 1 and 2) extending perpendicular to the plane defined by the two centerlines. It will be noted that the medicament opening resides on the longitudinal axis 27 although in another embodiment, this may not be the case.

Figure 9:
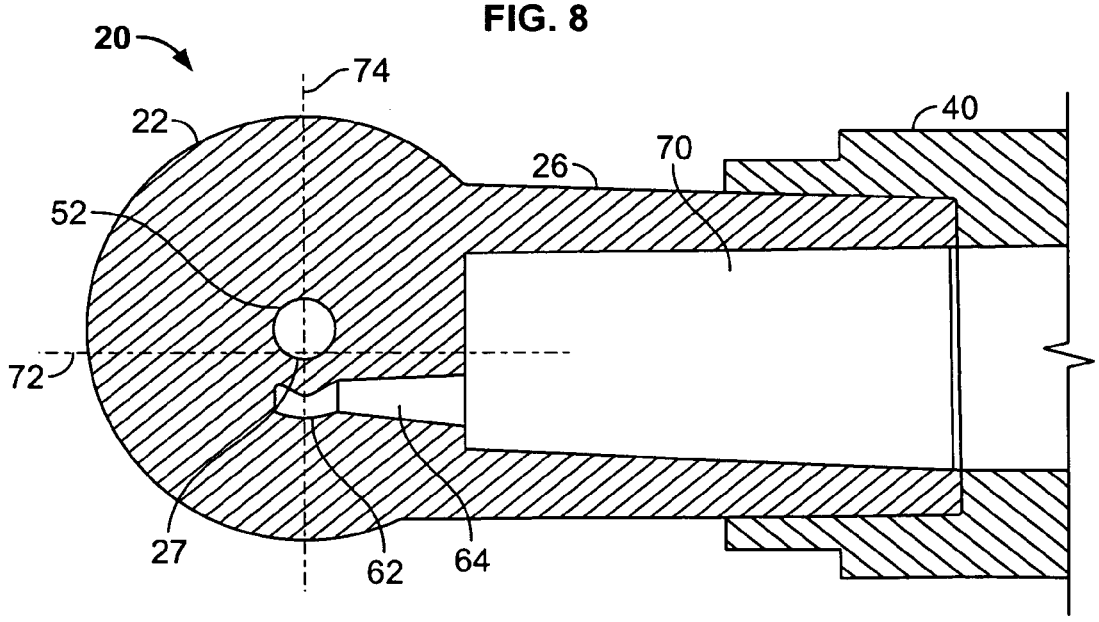
FIG. 9 is a cross-sectional top view of the body portion of the vial access device of FIGS. 1, 2, 6, and 7 showing the locations of the medicament and vent lumina and their respective cross-sectional shapes, as well as showing the internal shape of a vent section in the vent arm of the body portion.

FIG. 9 presents a cross-section view of portions of the medicament lumen 52 and vent lumen 62. Also visible is the right angle vent lumen portion 64 and the vent cavity 70 located in the vent arm 26. The figure also shows the centerlines 72 and 74. It will be noted that in this embodiment, the cross-sectional shape of the medicament lumen 52 is circular and is located on the longitudinal axis 27 although it is not centered on the axis. On the other hand, the cross-sectional shape of the vent lumen 62 is, in general, a polygon having four sides, one of which is generally concave, facing toward the medicament lumen, and the opposite of which is convex, facing away from the medicament lumen. Other shapes and locations of the vent lumen and the medicament lumen are possible as will become apparent to one of skill in the art.

Figure 10:
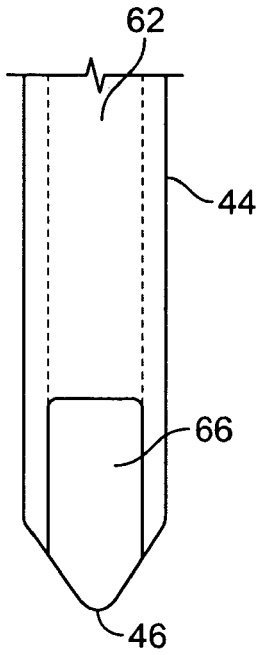
FIGS. 10 through 12 show various rotated side views of the cannula showing the relatively sharp tip in all views, and the vent opening in the cannula in FIGS. 10 and 11 rotated ninety degrees from each other, and an open channel or slot for the medicament opening in FIG. 12 which is rotated another ninety degrees from FIG. 11.
Figure 11:
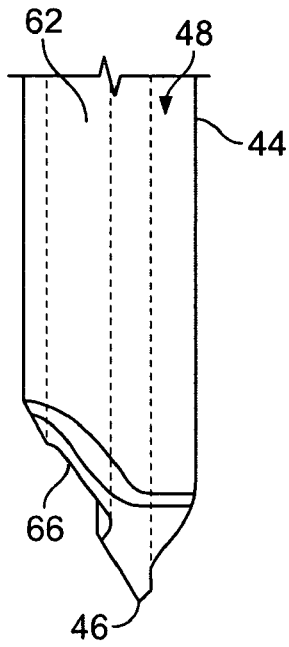
Figure 12:
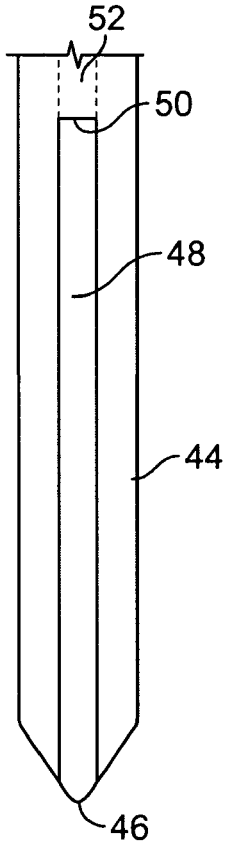

FIGS. 10, 11, and 12 are provided to show side views of an embodiment of the cannula 44 with the two lumina of the medicament 52 and the vent 62, and the relatively sharp tip 46 so that the configurations of the openings of the cannula can be seen. FIGS. 10 and 11 show the vent opening 66 with a rotation of ninety degrees between each figure. The vent opening leads to the vent lumen 62, which extends adjacent the open channel or slot 48, as shown in dashed lines in FIG. 11. FIG. 12 shows the cannula rotated another ninety degrees which is one-hundred and eighty degrees from FIG. 10; so that the open channel or slot 48 formed in the side of the cannula to provide fluid access to the medicament opening 50 on the medicament lumen 52 can clearly be seen. Other shapes, orientations, and locations of openings, slots and channels will become apparent to those of skill in the art.

Returning now to FIG. 7, the pressure-equalizing chamber 28 includes the equalizing port 57 and the pressure relief port 61. The pressure relief port serves as a port to the ambient atmosphere outside of the VAD during use to permit the volume control device 68 to move freely to equalize pressure within the vial. The equalizing port is adjacent the vent cavity 70 of the vent arm 26 and is in fluid communication with the vent lumen 62 of the cannula 44. The attachment stem 40 is a part of the chamber 28 and is used to mount the chamber to the vent arm. In another embodiment, the chamber, vent arm, and body may be integral.

The pressure-equalizing chamber 28 has an internal diameter 73 substantially greater than the internal diameter of the vent lumen 62, which provides a greater volume for equalizing the pressure within the vial 110 (FIG. 2). In the case of the freely-sliding disk 68 which is shown in FIG. 7 as a piston formed of a cylinder 69 closed at one end with the disk, the outer periphery fits tightly to the inner wall 72 of the chamber in this embodiment such that fluids cannot pass around the outer periphery of the sliding disk. As used herein, the term "fluid" is used in its common sense encompassing both liquids and gases. Additionally, the disk itself is formed of a material that is impermeable to liquids or gases and will not allow such materials to pass through it.

It will be appreciated that the present invention retains aerosols of medicament when accessing a vial of medicament. When a diluent is added to a vial to reconstitute medicament in dry or lyophilized form, air inside the vial is displaced by the added diluent and is moved to the pressure-equalizing chamber without allowing any particles or aerosols of the medicament to contaminate the ambient atmosphere. When medicament is withdrawn or aspirated from the vial, air from the ambient atmosphere is drawn into the pressure-equalizing chamber for the sole purpose of permitting stored gas to move from its storage location to equalize the pressure drop in the vial. The apparatus and method in accordance with the invention thus provide a sealed and closed system for reconstituting vial contents and aspirating them for use on patients.

It has also been found useful in some applications to have a valve placed in the vial access device to result in a closed system. The valved vial access device permits engagement of the sharpened cannula with the contents of the vial without leakage of fluid from the vial through the VAD until the valve is purposely opened via a syringe, for example. Then when the second fluid device has been prepared, it can be connected to the VAD thereby opening or activating the valve that then permits fluid flow between the vial and second fluid device.

While the present invention is applicable to hazardous materials in general, the specific example of hazardous materials to which the invention is particularly applicable are freeze dried or powdered cytotoxic drugs such as are used extensively in chemotherapy treatment of cancer patients and radiographic materials.

Although the present invention has been described in terms of certain preferred embodiments, other embodiments that are apparent to those of ordinary skill in the art are also within the scope of the invention. Accordingly, the scope of the invention is intended to be defined only by reference to the appended claims. While variations have been described and shown, it is to be understood that these variations are merely exemplary of the present invention and are by no means meant to be limiting.

What is claimed is:

1. A pressure-equalizing vial access device for retaining aerosols when accessing a vial having a pierceable seal located over an opening of the vial, the vial access device comprising:

a cannula having a medicament lumen and a vent lumen separate from the medicament lumen, the cannula having a relatively sharp tip to pierce the seal of the vial and a length selected so that the tip can be located within the vial;

a body portion having:

a medicament port in fluid communication with the medicament lumen of the cannula, the medicament port configured to receive a connector from a second container to allow liquid to be introduced into and removed from the vial; and a vent port in fluid communication with the vent lumen of the cannula, the vent port being separate from the medicament port and configured to allow passage of fluid to and from the vent lumen; and a rigid chamber located in fluid communication with the vent port and the vent lumen without being in fluid communication with the medicament port or medicament lumen, the rigid chamber having a pressure relief port open to atmosphere and an equalizing port connecting to the vent port and vent lumen, the rigid chamber having rigid walls and a fixed internal volume, the rigid chamber comprising:

a filter disposed at the equalizing port of the rigid chamber so that any fluid passing between the rigid chamber and the vent port must pass through the filter; and a volume control device located within and entirely confined by the rigid chamber providing a sealed barrier between the equalizing port and the pressure relief port and freely movable between the equalizing port and the pressure relief port to vary the internal volume of the rigid chamber available to the equalizing port in response to pressure changes occurring in the vent lumen;

whereby increases in pressure in the vial resulting from the introduction of liquid for reconstitution of vial contents are equalized by the volume control device moving away from the equalizing port to create a greater volume in the vent lumen/rigid chamber combination and decreases in pressure in the vial resulting from aspiration of reconstituted liquid from the vial contents are equalized by the volume control device moving toward the equalizing port to create a lesser volume in the vent lumen/rigid chamber combination.

2. The pressure-equalizing vial access device of claim 1, wherein the volume control device automatically moves within the rigid chamber to vary the volume of the rigid chamber adjacent the equalizing port to accommodate an increase in pressure in the vial or a decrease in pressure in the vial so that the pressure within the vial is maintained at approximately atmospheric pressure.

3. The pressure-equalizing vial access device of claim 1, wherein the volume control device comprises a sliding disk freely movable within the rigid chamber between the equalizing port and the pressure relief port to vary the volume of the rigid chamber available to the equalizing port and vent lumen, the disk having an outer periphery having a seal in contact with an inner wall of the rigid chamber to seal the vent lumen from the pressure relief port of the rigid chamber.

4. The pressure-equalizing vial access device of claim 1, wherein the volume control device comprises a cylinder closed at one end having a seal located at its outer periphery.

5. The pressure-equalizing vial access device of claim 1, wherein the filter comprises a hydrophobic membrane.

6. The pressure-equalizing vial access device of claim 1, wherein the volume control device comprises a flexible bladder mounted within the rigid chamber such that the bladder compresses when the volume between the equalizing port and the volume control device increases.

7. The pressure-equalizing vial access device of claim 1, wherein the volume control device comprises a flexible bladder mounted within the rigid chamber such that the flexible bladder expands when the volume between the equalizing port and the volume control device decreases.

8. The pressure-equalizing vial access device of claim 1, wherein the rigid chamber is formed of a clear material such that the volume control device is visible and can indicate visually the volume available for air to be injected into the vial and liquid to be removed from the vial.

9. The pressure-equalizing vial access device of claim 7, wherein the bladder is formed of a vapor impermeable material thereby sealing the rigid chamber from gases escaping the vial.

10. The pressure-equalizing vial access device of claim 1, wherein the rigid chamber is formed so that the volume within it on both sides of the volume control device when centered is equal to the volume of space within an empty vial.

11. The pressure-equalizing vial access device of claim 1, wherein the medicament port comprises a needle free valve.

12. The pressure-equalizing vial access device of claim 11, wherein the needle free valve comprises a female Luer connection port.

13. A pressure-equalizing vial access device for retaining aerosols when accessing a vial having a pierceable seal located over an opening of the vial and a vial volume, the vial access device comprising:

a flexible attachment device configured to engage the vial for secure mounting of the vial access device to the vial;

a cannula on the attachment device, the cannula having a sharpened tip configured to pierce the seal of the vial, a vent opening adjacent the sharpened tip, and a medicament opening, the vent opening leading to a vent lumen extending through the cannula, the medicament opening leading to a medicament lumen extending through the cannula;

a body portion having:

a medicament port in fluid communication with the medicament lumen of the cannula, the medicament port configured to receive a connector from a second container to allow liquid to be introduced into and removed from the vial; and a vent port in fluid communication with the vent lumen of the cannula, the vent port being separate from the medicament port and configured to allow passage of gas to and from the vial; and a rigid chamber located in fluid communication with the vent port without being in fluid communication with the medicament port or medicament lumen, the rigid chamber having a pressure relief port open to atmosphere and an equalizing port connecting to the vent port, the rigid chamber having rigid walls with a fixed internal volume, that internal volume being at least as great as the vial volume, the rigid chamber comprising:

a hydrophobic filter disposed at the equalizing port of the rigid chamber so that any fluid passing between the rigid chamber and the vent port must pass through the hydrophobic filter; and a freely-movable volume control device located within and entirely confined by the rigid chamber providing a sealed barrier between the equalizing port and the pressure relief port and freely movable within the rigid chamber to vary the volume within the rigid chamber between the equalizing port and the volume control device in response to pressure changes occurring at the equalizing port;

whereby increases in pressure in the vial resulting from the introduction of liquid for reconstitution of vial contents are equalized by the volume control device moving away from the equalizing port to create a greater volume in the vent lumen/rigid chamber combination and decreases in pressure in the vial resulting from aspiration of reconstituted liquid from the vial contents are equalized by the volume control device moving toward the equalizing port to create a lesser volume in the vent lumen/rigid chamber combination.

14. The pressure-equalizing vial access device of claim 13, wherein the volume control device automatically moves within the rigid chamber to vary the volume of the rigid chamber adjacent the equalizing port to accommodate an increase in pressure in the vial or a decrease in pressure in the vial so that the pressure within the vial is maintained at approximately atmospheric pressure.

15. The pressure-equalizing vial access device of claim 13, wherein the volume control device comprises a sliding disk freely movable within the rigid chamber between the equalizing port and the pressure relief port to vary the volume of the rigid chamber available to the equalizing port and vent lumen, the disk having an outer periphery having a seal in contact with an inner wall of the rigid chamber to seal the vent lumen from the pressure relief port of the rigid chamber.

16. The pressure-equalizing vial access device of claim 15, wherein the volume control device comprises a cylinder closed at one end with the sliding disk and having a seal located at its outer periphery.

17. The pressure-equalizing vial access device of claim 13, wherein the volume control device comprises a flexible bladder mounted within the rigid chamber such that the bladder compresses when the volume between the equalizing port and the volume control device increases.

18. The pressure-equalizing vial access device of claim 17, wherein the flexible bladder expands when the volume between the equalizing port and the volume control device decreases.

19. The pressure-equalizing vial access device of claim 13, wherein the rigid chamber is formed of a clear material such that the volume control device is visible and can indicate visually the volume available for air to be injected into the vial and liquid to be removed from the vial.

20. The pressure-equalizing vial access device of claim 17, wherein the bladder is formed of a vapor impermeable material thereby sealing the rigid chamber from gases escaping the vial.

21. The pressure-equalizing vial access device of claim 13, wherein the rigid chamber is formed so that the volume within it on both sides of the volume control device when centered is equal to the volume of space within an empty vial.

22. The pressure-equalizing vial access device of claim 13, wherein the medicament port comprises a needle free valve.

23. The pressure-equalizing vial access device of claim 22, wherein the needle free valve comprises a female luer connection port.

24. A method for retaining aerosols when accessing a vial having a pierceable seal located over an opening of the vial, the method comprising:

piercing the vial seal to establish fluid communication with vial contents;

conducting liquid into the vial through a medicament lumen;

when pressure in the vial increases above atmospheric pressure, conducting gas out of the vial through a vent lumen which is separate from the medicament lumen;

filtering the gas conducted out of the vial;

confining the filtered gas conducted out of the vial in a sealed container having rigid walls and a fixed volume;

dividing the sealed container into two compartments;

varying the volume of a first compartment of the sealed container to receive the filtered gas conducted out of the vial and equalize the received filtered gas to atmospheric pressure thereby equalizing the pressure in the vial to atmospheric pressure; returning the received filtered gas to the vial when pressure in the vial decreases below atmospheric pressure thereby equalizing the pressure in the vial to atmospheric pressure; whereby increases in pressure in the vial resulting from the introduction of liquid for reconstitution of vial contents are equalized by increasing the volume in the first compartment of the rigid chamber combination and decreases in pressure in the vial resulting from aspiration of reconstituted liquid from the vial contents are equalized by decreasing the volume of the first compartment; wherein the step of varying the volume of the first compartment comprises automatically moving a sealed barrier located within the rigid container in response to pressure changes in the vial to vary the volume of the first compartment; wherein the step of moving a sealed barrier further comprises automatically moving a freely-movable sliding disk within the rigid container in response to pressure changes in the vial to vary the volume of the first compartment, the sliding disk sealing the first compartment from the atmosphere.

25. The method of claim 24, wherein the step of filtering comprises blocking the passage of liquid.

26. A method for retaining aerosols when accessing a vial having a pierceable seal located over an opening of the vial, the method comprising: piercing the vial seal to establish fluid communication with vial contents; conducting liquid into the vial through a medicament lumen; when pressure in the vial increases above atmospheric pressure, conducting gas out of the vial through a vent lumen which is separate from the medicament lumen; filtering the gas conducted out of the vial; confining the filtered gas conducted out of the vial in a sealed container having rigid walls and a fixed volume; dividing the sealed container into two compartments; varying the volume of a first compartment of the sealed container to receive the filtered gas conducted out of the vial and equalize the received filtered gas to atmospheric pressure thereby equalizing the pressure in the vial to atmospheric pressure; returning the received filtered gas to the vial when pressure in the vial decreases below atmospheric pressure thereby equalizing the pressure in the vial to atmospheric pressure; whereby increases in pressure in the vial resulting from the introduction of liquid for reconstitution of vial contents are equalized by increasing the volume in the first compartment of the rigid chamber combination and decreases in pressure in the vial resulting from aspiration of reconstituted liquid from the vial contents are equalized by decreasing the volume of the first compartment; wherein the step of varying the volume of the first compartment comprises automatically moving a sealed barrier located within the rigid container in response to pressure changes in the vial to vary the volume of the first compartment; wherein the step of moving a sealed barrier further comprises automatically moving a freely-movable flexible bladder within the rigid container in response to pressure changes in the vial to vary the volume of the first compartment, the flexible bladder sealing the first compartment from the atmosphere; wherein the step of varying the volume further comprises mounting the flexible bladder within the rigid-walled container such that the bladder compressed to receive gas from the vial and expands to provide gas to the vial, the bladder contained within the rigid container such that the bladder in its expanded and compressed states is contained entirely within the rigid container.

27. The method of claim 24, further comprising the step of viewing the volume available in the rigid container through the wall of the rigid container to determine the amount of liquid for injection into the vial.

28. The method of claim 24, further comprising controlling the injection and aspiration of fluid from the vial with a needle free valve disposed in the path of the medicament lumen.

29. The method of claim 28, further comprising receiving a Luer connector of a second container with a Luer-shaped connector located in the path of the medicament lumen.

* * * * *